US005999778A

United States Patent [19]

Chang et al.

[11] Patent Number: 5,999,778

[45] Date of Patent: Dec. 7, 1999

[54] DEVELOPING DEVICE OF WET TYPE PRINTER

[75] Inventors: Kee-son Chang; Wan-ha Kim; Jin-geun Kwak, all of Suwon, Rep. of Korea

[73] Assignee: Samsung Electronics Co., Ltd., Kyungki-do, Rep. of Korea

[21] Appl. No.: 09/126,602

[22] Filed: Jul. 31, 1998

[30] Foreign Application Priority Data

Aug. 26, 1997 [KR] Rep. of Korea ..... 97-41197

[51] Int. Cl.[6] ..... G03G 15/10; G03G 21/00

[52] U.S. Cl. ..... 399/237; 15/256.5; 399/248; 399/348; 399/349

[58] Field of Search ..... 399/237, 348, 399/248, 349, 343; 15/256.5, 256.51, 256.52

[56] References Cited

U.S. PATENT DOCUMENTS

| | | | |
|---|---|---|---|
| 3,730,708 | 5/1973 | Jugle | 399/237 X |
| 3,865,611 | 2/1975 | Sato et al. | 399/237 X |
| 4,102,306 | 7/1978 | Ohta | 399/237 X |
| 4,299,902 | 11/1981 | Soma et al. | 399/248 X |
| 5,064,738 | 11/1991 | Rakov et al. | 399/237 X |
| 5,175,591 | 12/1992 | Dunn et al. | 15/256.52 X |
| 5,339,149 | 8/1994 | Lindblad et al. | 399/349 X |
| 5,893,012 | 4/1999 | Schubert et al. | 399/237 |

FOREIGN PATENT DOCUMENTS 2-118589 5/1990 Japan .

*Primary Examiner*—Arthur T. Grimley
*Assistant Examiner*—Sophia S. Chen
*Attorney, Agent, or Firm*—Sughrue, Mion, Zinn, Macpeak & Seas, PLLC

[57] ABSTRACT

A developing device, of a wet type printer, provided with a reservoir for holding developer liquid. A developing roller is installed at an upper region of the reservoir, and contacts a photosensitive belt. A cleaning device for cleaning the developing roller, is in contact with the developing roller. An auxiliary reservoir is installed below the developing roller, and within the reservoir, to hold a predetermined amount of the developer liquid in which the lower portion of the developing roller is immersed to a predetermined depth. The cleaning device is installed within the auxiliary reservoir to be immersed in the developer liquid and is provided with a rotating shaft and a brush installed around the circumferential surface of the rotating shaft. The developing roller is effectively cleaned, by the cleaning device, and particles adhering to the developing roller are easily removed. The removed particles are then recovered and used again in subsequent printing operations.

20 Claims, 6 Drawing Sheets

DEVELOPING DEVICE OF WET TYPE PRINTER

BACKGROUND OF THE INVENTION

1. Field of the Invention

The present invention relates to a developing device of a wet type printer, and more particularly, to a developing device of a wet type printer in which the efficiency of cleaning a developing roller and the recovery rate of developer particles are enhanced.

2. Description of the Related Art

In general, an electrographic printer such as a laser printer uses a photosensitive medium such as a photosensitive belt on which a latent electrostatic image is formed. The electrographic printers are classified into two major groups, i.e., wet type printers and dry type printers according to the type of developer used. The wet type printers use a developer composed of a mixture of a volatile liquid carrier and a toner. The wet type electrographic printers using such a liquid developer exhibit better print quality than dry type electrographic printers which use powder toner. Further, the wet type printers prevent suffering from hazardous toner dust and are, therefore, being increasingly used.

Referring to FIG. 1, a photosensitive belt 110 circulates in a closed loop around three rollers 121, 122 and 123. The first roller 121 transfers a toner image formed on the photosensitive belt 110 to a transfer roller 124. The transfer roller 124 then transfers the transferred toner image to a paper 125. A pressing roller 128, which contacts the transfer roller 124 with the paper 125 therebetween, presses the paper 125 toward the transfer roller 124 at a constant pressure to transfer the toner image on the transfer roller 124 to the paper 125. A charging device 135, for charging the photosensitive surface of the photosensitive belt 110, is positioned along the path of the photosensitive belt 110 between the first roller 121 and the second roller 122. Laser scanning units 130 form a latent electrostatic image by illuminating a laser beam on the photosensitive surface of the photosensitive belt 110. Developing devices 140 of respective colors develop the latent electrostatic image into the toner image by supplying the scanned photosensitive surface with developer liquid. The laser scanning units 130 and the developing devices are alternately installed along the path of the photosensitive belt 110 between the second roller 122 and the third roller 123. Pairs of backup rollers 126 and 127, corresponding to the respective developing devices 140, are installed inside the photosensitive belt 110 between the second roller 122 and the third roller 123.

Referring to FIG. 2, the conventional developing device 140 is provided with a first squeegee roller 146 and a developing roller 143 corresponding to the backup rollers 126 and 127. A cleaning roller 144 which rotates in the same direction as the developing roller 143, is installed at a lower part of the developing roller 143. A lower portion of the cleaning roller 144 is immersed in developer liquid 141. A second squeegee roller 147 is installed alongside of the first squeegee roller 146. The squeegee rollers 146 and 147 squeegee the developer liquid adhering to the photosensitive belt 110. Scrapers 146*a* and 147*a* remove developer liquid from squeegee rollers 146 and 147, respectively. A developer liquid supplying device 148 is installed alongside of the developing roller 143. A blade 149 installed between the developer liquid supplying device 148 and the developing roller 143 for preventing the developer liquid supplied from the developer liquid supplying device 148 from flowing in a direction opposite that of the rotation of the developing roller 143.

As shown in FIGS. 3 and 4, the tubular rotating shaft 200 of the cleaning roller 144 is provided with developer liquid passages 232 on the circumferential surface thereof. A plurality of cleaning members 201 are closely fitted on the circumferential surface of the tubular rotating shaft. Since the cleaning roller 144 rotates in the same direction as does the developing roller 143, there is friction between the cleaning members 201 and the developing roller 143 thereby cleaning the surface of the developing roller 143. Developing liquid for cleaning developing roller 143 is supplied through a cavity 202 of the tubular rotating shaft 200.

In the conventional developing device as described above, the structure of the cleaning device for cleaning the developing roller 143 is complicated. In addition, when the cleaning members are partially abraded, some particles of the developer liquid remain adhered to the developing roller 143. The remaining particles are separated from the developing roller 143 by the blade 149. The removed particles may adhere to the developer liquid supplying device in a sludge state, and accordingly recovery of particles for reuse is not effectively accomplished. Further, because the developing roller and the cleaning roller are driven by separate motors and the relative frictional force is relatively large, more powerful motors are required.

SUMMARY OF THE INVENTION

To solve the above problems, it is an objective of the present invention to provide a developing device of a wet type printer having a simplified structure.

It is another objective of the present invention to provide a developing device of a wet type printer in which the recovery rate of developer particles is high.

It is still another objective of the present invention to provide a developing device of a wet type printer in which a cleaning roller is driven by a relatively less powerful motor, then in the related art.

Accordingly, to achieve the above objectives, there is provided a developing device, of a wet type printer, provided with a reservoir for holding developer liquid, a developing roller installed at the upper region of the reservoir and in contact with a photosensitive belt installed in the printer, and a cleaning device for cleaning the developing roller, wherein an auxiliary reservoir is installed below the developing roller and within the reservoir to hold a predetermined amount of the developer liquid in which the lower portion of the developing roller is immersed to a predetermined depth; the cleaning device is installed within the auxiliary reservoir, immersed in the developer liquid, and in contact with the developing roller wherein the cleaning device is provided with a rotating shaft and a brush installed around the circumferential surface of the rotating shaft.

In the developing device of the present invention, the cleaning device preferably includes a rotating shaft and a brush fastened around the shaft.

In addition, it is preferable that an auxiliary developer liquid supplying device is provided for the auxiliary reservoir. Also, a developer liquid supplying device is provided at one side of the reservoir to supply the developer liquid to the photosensitive belt. Alternatively, a developer liquid supplying device is provided for supplying developer liquid to the auxiliary reservoir, and the developing roller then supplies the developer liquid adhering to the circumferential surface thereof to the photosensitive belt.

BRIEF DESCRIPTION OF THE DRAWINGS

The above objectives and advantages of the present invention will become more apparent by describing in detail preferred embodiments thereof with reference to the attached drawings, in which.

DESCRIPTION OF THE PREFERRED EMBODIMENTS

Embodiment 1

Figure 1:
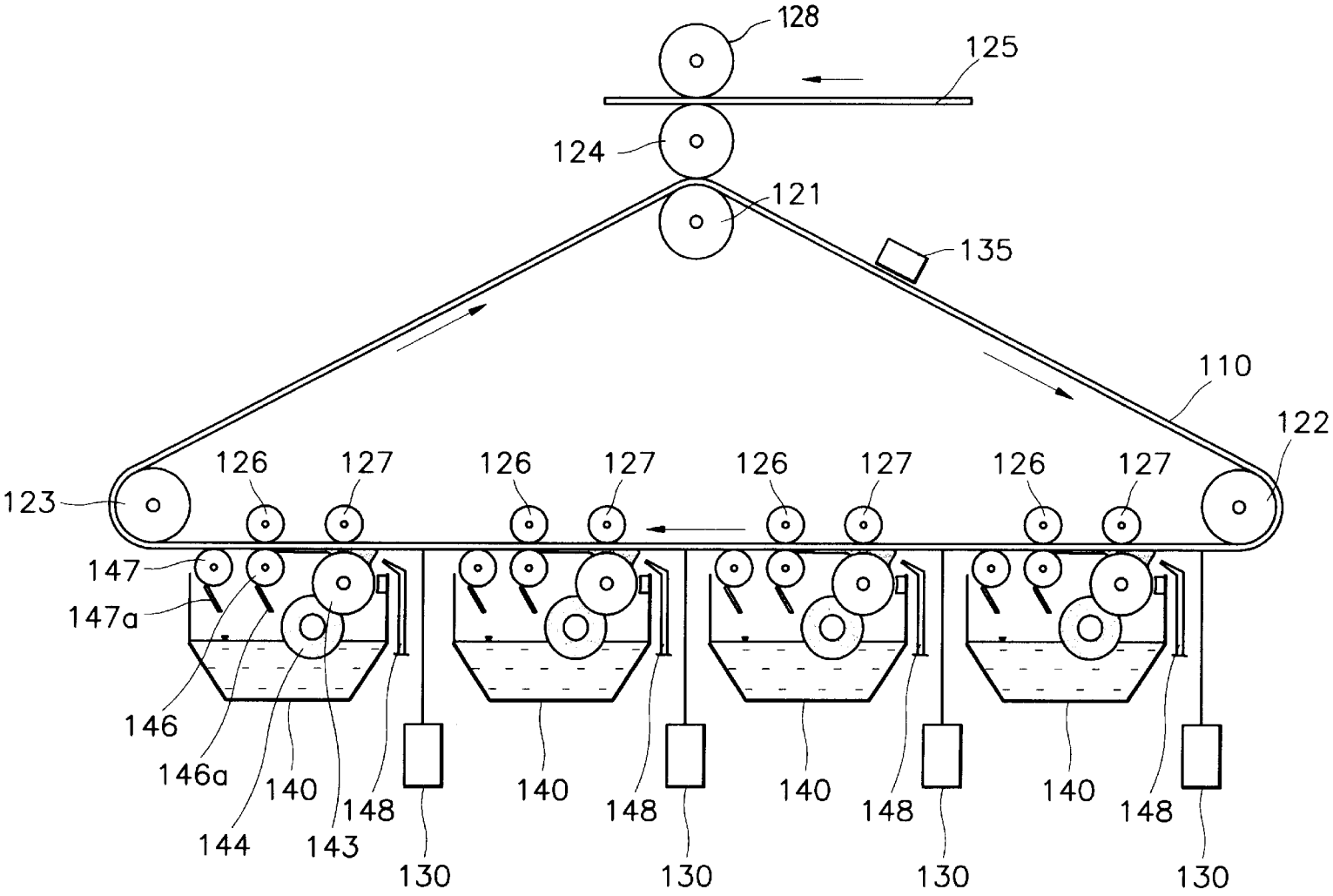
FIG. 1(PRIOR ART)
FIG. 1 is a schematic diagram illustrating a wet type printer employing a conventional developing device.
Figure 2:
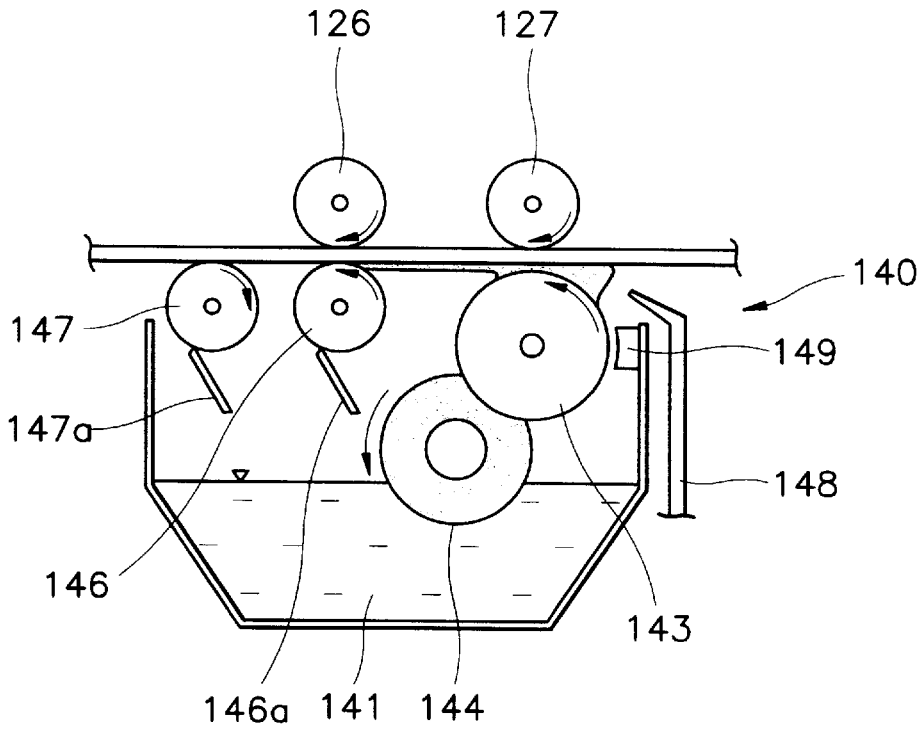
FIG. 2(PRIOR ART)
FIG. 2 is a schematic diagram illustrating essential parts of a conventional developing device.
Figure 3:
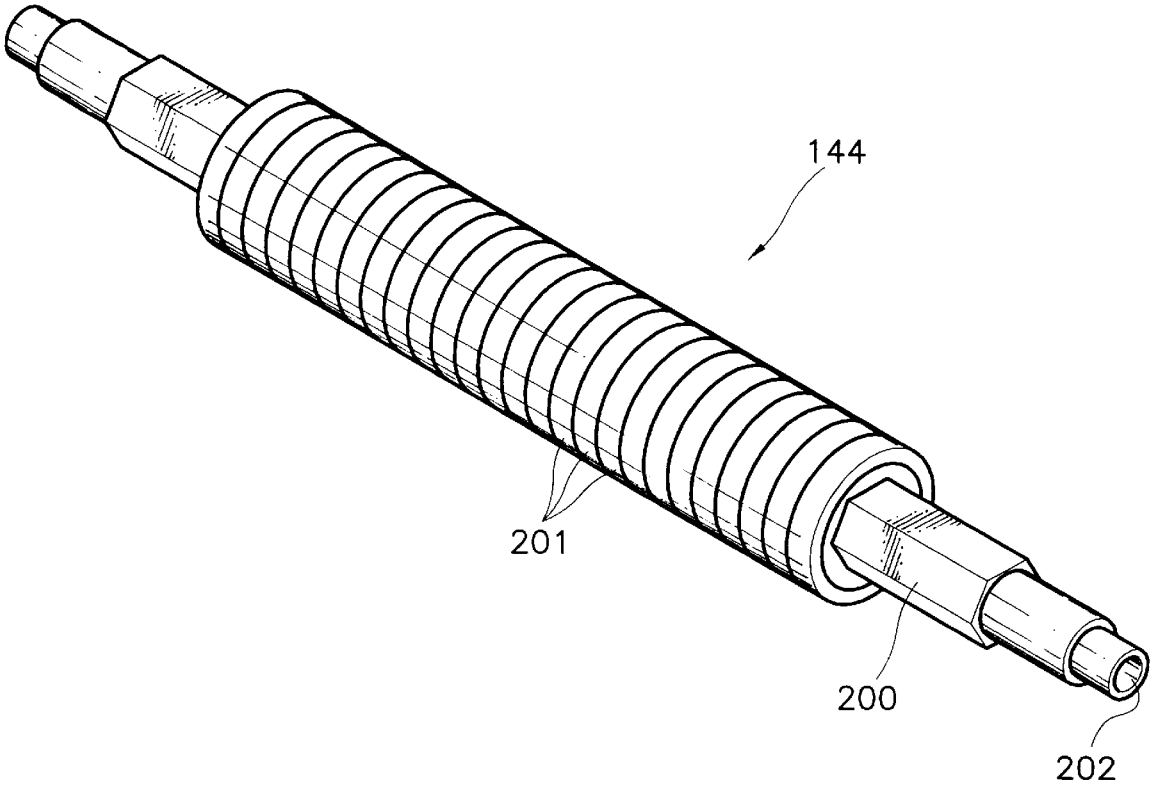
FIG. 3(PRIOR ART)
FIG. 3 is a schematic perspective view illustrating a cleaning roller applicable to a conventional developing device.
Figure 4:
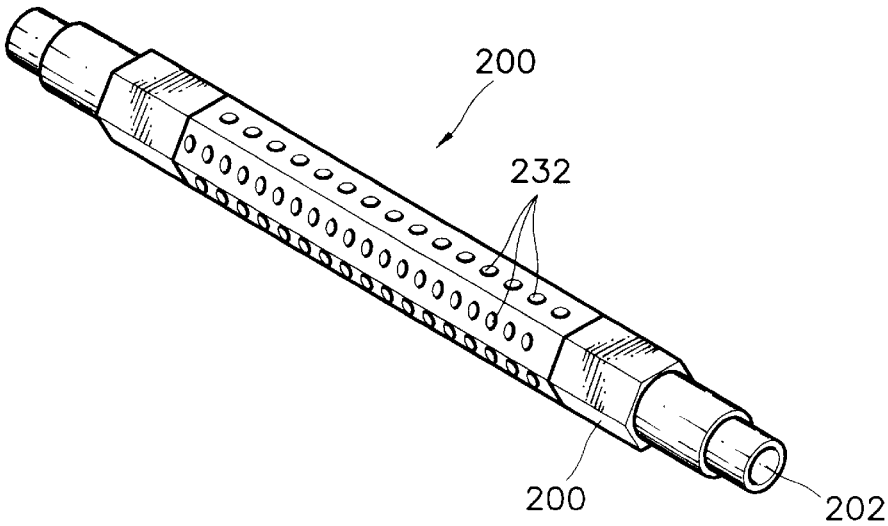
FIG. 4(PRIOR ART)
FIG. 4 is a schematic perspective view illustrating the rotating shaft of the cleaning roller of FIG. 3.
Figure 5:
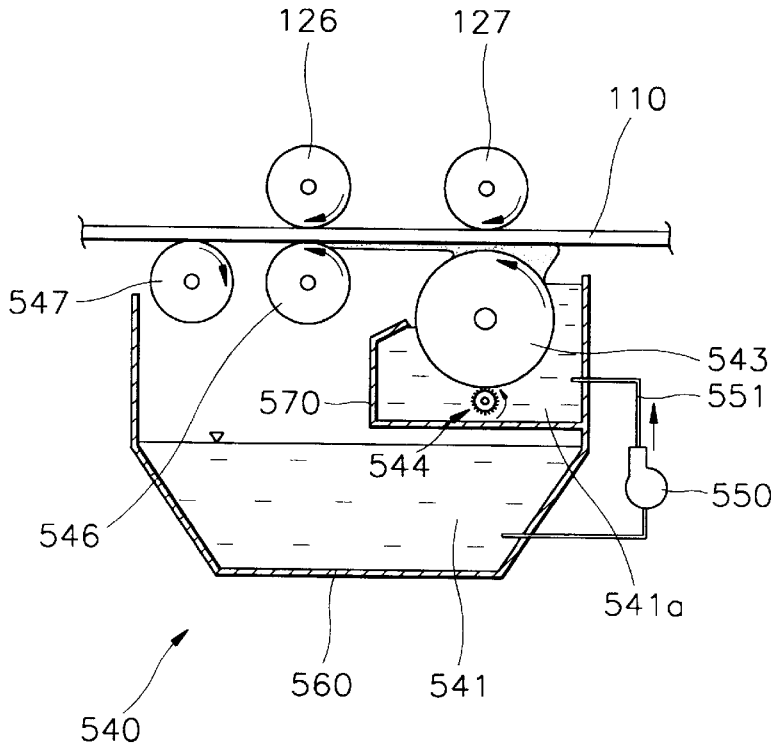
FIG. 5 is a schematic diagram illustrating a first embodiment of a developing device according to the present invention.

Referring to FIG. 5, a developing device 540 is provided under a photosensitive belt 110 which is supported by backup rollers 126 and 127. A developing roller 543, a first squeegee roller 546 and a second squeegee roller 547 are positioned at an upper region of the developing device 540 within a reservoir 560 which holds developer liquid 541.

The developing roller 543 and the first squeegee roller 546 rotate in the proceeding direction of the photosensitive belt 110, but the second squeegee roller 547 rotates in the opposite direction. An auxiliary reservoir 570 is installed below the developing roller 543. The auxiliary reservoir 570 holds developer liquid 541*a* in which the lower part of the developing roller 543 is immersed.

A cleaning roller 544 is installed to contact the developing roller 543 in the developer liquid 541*a*. The cleaning roller 544 rotates in the same direction as the developing roller 543. The auxiliary reservoir 570 and the reservoir 560 are in communication through a developer liquid supplying tube 551. A pump 550 is provided in the middle of the tube 551 for supplying the developer liquid of the reservoir 560 to the auxiliary reservoir 570.

Figure 6:
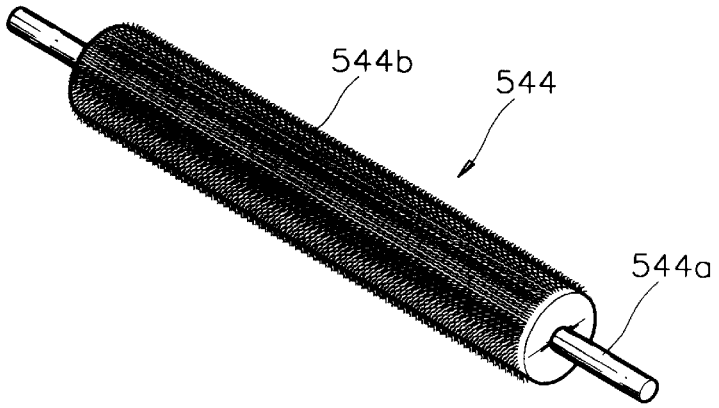
FIG. 6 is a schematic perspective view illustrating a cleaning roller Applicable to a developing device according to the present invention.

The cleaning roller 544 has a structure in which a soft brush 544*b* is fastened around the rotating shaft 544*a*, as shown in FIG. 6. The cleaning roller 544 rotates in the same direction as the developing roller 543, as described above, and is driven by the same motor (not shown) which drives the developing roller 543. Alternatively, separat,e motors can be provided to drive the cleaning roller 544 and the developing roller 543.

When printing is performed, and the scanned photosensitive belt 110 proceeds, developer liquid supplied from the developer liquid supplying device (similar to developer liquid supplying device 148) is coated on the scanned surface of photosensitive belt 110 adjacent the developing roller 543. As the photosensitive belt 110 passes by the developing roller 543 and the squeegee rollers 546 and 547, the developer liquid layer on the photosensitive belt 110 becomes thin. Developer liquid separated from the photosensitive belt 110 is recovered in the reservoir 560. When the photosensitive belt 110 proceeds, the cleaning roller 544 rotates simultaneously therewith. At this time, because the cleaning roller 544 and the developing roller 543 rotate in the same direction, there is a relatively strong frictional force at the contact portions between the two rollers 543 and 544. Therefore, foreign substances such as toner particles adhering to the developing roller 543 are separated and recovered into the developer liquid 541*a*. Since the contact portions between the developing roller 543 and the cleaning roller 544 are immersed in the developer liquid 541*a*, the particles adhering to the developing roller 543 are easily separated.

When the developer liquid level in the auxiliary reservoir 570 is below a predetermined level, the pump 550 operates to restore the developer liquid 541*a* to an appropriate level in the auxiliary reservoir 570. In addition, when excess developer liquid is supplied, the excess developer liquid overflows from the auxiliary reservoir 570 and into the reservoir 560.

Embodiment 2

Figure 7:
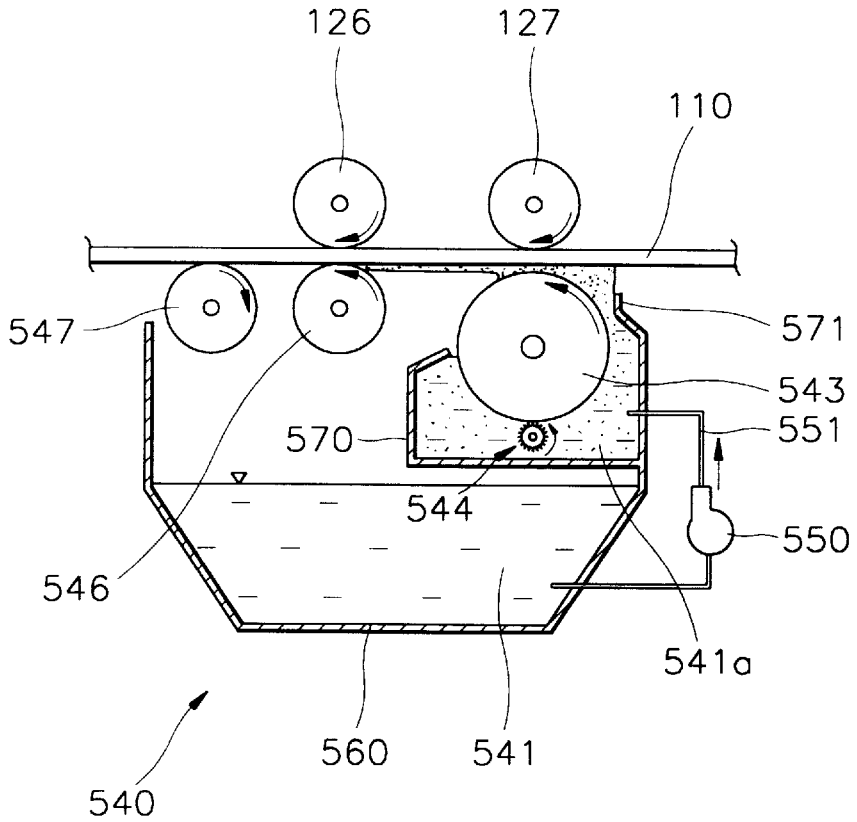
FIG. 7 is a schematic diagram illustrating a second embodiment of a developing device according to the present invention.

Referring to FIG. 7, a developing device 540 is provided under a photosensitive belt 110 which is supported by backup rollers 126 and 127. A developing roller 543, a first squeegee roller 546 and a second squeegee roller 547 are positioned at the upper region of the developing device 540 within a reservoir 560 which holds developer liquid 541.

The developing roller 543 and the first squeegee roller 546 rotate in the proceeding direction of the photosensitive belt 110, but the second squeegee roller 547 rotates in the opposite direction. An auxiliary reservoir 570 is installed below the developing roller 543. The auxiliary reservoir 570 holds developer liquid 541*a*, in which the lower part of the developing roller 543 is immersed.

A cleaning roller 544 is installed to contact the developing roller 543 in the developer liquid 541*a*. The cleaning roller 544 rotates in the same direction as the developing roller 543. The auxiliary reservoir 570 and the reservoir 560 are in communication through a developer liquid supplying tube 551. A pump 550 is provided in the middle of the tube 551 for supplying the developer liquid of the reservoir 560 to the auxiliary reservoir 570.

The cleaning roller 544 has a structure in which a soft brush 544*b* is fastened around the rotating shaft 544*a*, as shown in FIG. 6. The cleaning roller 544 rotates in the same direction as the developing roller 543, as in the previous embodiment described above, and is driven by the same motor (not shown) which drives the developing roller 543. Alternatively, separate motors can be provided to drive the cleaning roller 544 and the developing roller 543.

A smoothing portion 571, for smoothing the developer liquid layer on the developing roller 543 is installed at one side of the upper portion of the auxiliary reservoir 570 in the vicinity of the developing roller 543 at a predetermined distance therefrom. The smoothing portion 571 evens the thickness of the developer liquid adhering to the developer roller 543. A part of the auxiliary reservoir 570 may serve as the smoothing portion 571, as shown in FIG. 7, or a separate member may be provided.

When printing is performed, and the scanned photosensitive belt 110 proceeds, developer liquid supplied from the developer liquid supplying device (similar to developer liquid supplying device 148) is coated on the scanned surface of the photosensitive belt 110 adjacent the developing roller 543. As the photosensitive belt 110 passes by the developing roller 543 and the squeegee rollers 546 and 547, the developer liquid layer on the photosensitive belt 110 becomes thin. Developer liquid separated from the photosensitive belt 110 is recovered in the reservoir 560. When the photosensitive belt 110 proceeds, the cleaning roller 544 rotates simultaneously therewith. At this time, because the cleaning roller 544 and the developing roller 543 rotate in the same direction, there is a relatively strong frictional force at the contact portions between the two rollers 543 and 544. Therefore, foreign substances such as toner particles adhering to the developing roller 543 are separated and recovered into the developer liquid 541*a*. Since the contact portions between the developing roller 543 and the cleaning roller 544 are immersed in the developer liquid 541*a*, the particles adhering to the developing roller 543 are easily separated.

When the developer liquid level in the auxiliary reservoir 570 is below a predetermined level, the pump 550 operates to restore the developer liquid 541*a* in the auxiliary reservoir 570 to an appropriate level.

Embodiment 3

Figure 8:
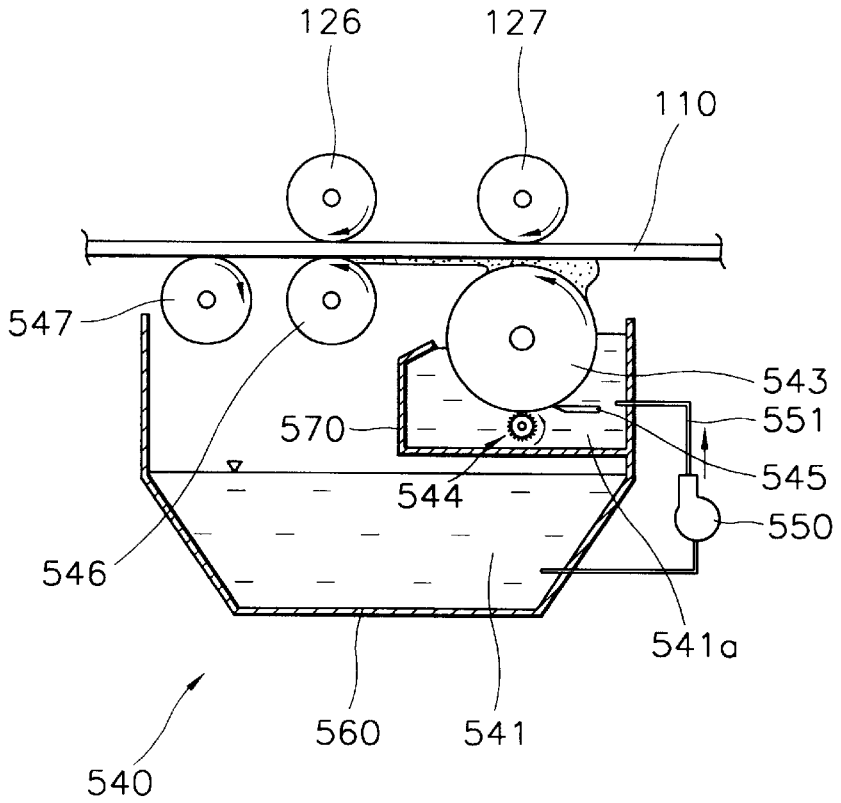
FIG. 8 is a schematic diagram illustrating a third embodiment of a developing device according to the present invention.

Referring to FIG. 8, Embodiment 3 will now be described. In addition to the structure of Embodiment 1 described above, Embodiment 3 includes a blade 545 installed at a lower part of a developing roller 543 to mechanically remove foreign substances adhering to the circumferential surface of the developing roller 543. The blade 545 is immersed in the developer liquid 541*a*, as shown in FIG. 8. Alternatively, the blade 545 can be provided so that it is not immersed in the developer liquid 541*a*, i.e., so that it is exposed to the atmosphere. However, in order to effectively clean the developing roller 543, it is preferable that the blade 545 is immersed in the developer liquid 541*a*.

With the present invention described above, a developing roller can be effectively cleaned. That is, a soft brush which can be driven with little force is employed. Further because the contacting portion of the brush is immersed in developer liquid, or is fully saturated with the developer liquid, particles adhering to the developing roller can be easily removed. The removed particles can then be recovered and used again in the printing operation. In addition, since the structure of a cleaning roller is simplified, the cleaning roller can be easily fabricated, and the malfunction rate of the cleaning roller is decreased. In particular, since the cleaning roller of the present invention includes a brush, damage to the surface of the developing roller is effectively prevented.

Although particular embodiments of the invention have been described with reference to the accompanying drawings, for the purposes of illustration, it should be understood that various modifications and equivalents may be made by those skilled in the art without departing from the spirit and scope of the invention. Accordingly, it must be understood that the invention is limited only by the attached claims.

What is claimed is:

1. A developing device, of a wet type printer, comprising:

a reservoir for holding developer liquid;

a developing roller installed at an upper region of the reservoir, said developing roller for contacting a photosensitive belt installed in the printer; and a cleaning device for cleaning the developing roller, said cleaning device is provided with a rotatable shaft and a brush installed around the circumferential surface of the rotatable shaft, said cleaning device being in contact with the developing roller, wherein said developing roller and said rotatable shaft rotate in the same direction, and the cleaning device is installed within the reservoir so as to be immersed in the developer liquid.

2. The developing device of a wet type printer as claimed in claim 1, further comprising:

an auxiliary reservoir installed below the developing roller and within the reservoir to hold a predetermined amount of the developer liquid in which the lower portion of the developing roller is immersed to a predetermined depth, wherein said cleaning device is installed within said auxiliary reservoir.

3. The developing device of a wet type printer as claimed in claim 2, wherein an auxiliary developer liquid supplying device is provided for the auxiliary reservoir, and a developer liquid supplying device is provided at one side of the reservoir to supply developer liquid to the photosensitive belt.

4. The developing device of a wet type printer as claimed in claim 3, wherein a blade is installed in contact with the developing roller in order to mechanically clean the surface of the developing roller.

5. The developing device of a wet type printer as claimed in claim 3, wherein the developer liquid supplying device includes a tube having an outlet directed toward a point where the photosensitive belt opposes the developing roller.

6. The developing device of a wet type printer as claimed in claim 5, wherein a blade is installed in contact with the developing roller in order to mechanically clean the surface of the developing roller.

7. The developing device of a wet type printer as claimed in claim 5, further comprising a smoothing portion located on one side of said auxiliary reservoir, and adjacent said developing roller.

8. The developing device of a wet type printer as claimed in claim 3, wherein the auxiliary developer liquid supplying device includes a tube connected between said reservoir and said auxiliary reservoir.

9. The developing deice of a wet type printer as claimed in claim 8, wherein the auxiliary developer liquid supplying device further includes a pump, connected to said tube.

10. The developing device of a wet type printer as claimed in claim 2, wherein an auxiliary developer liquid supplying device is provided for the auxiliary reservoir, and the developing roller supplies developer liquid adhering to the circumferential surface thereof to the photosensitive belt.

11. The developing device of a wet type printer as claimed in claim 10, wherein a place is installed in contact with the developing roller in order to mechanically clean the surface of the developing roller.

12. The developing device of a wet type printer as claimed in claim 10, wherein the auxiliary developer liquid supplying device includes a tube connected between said reservoir and said auxiliary reservoir.

13. The developing deice of a wet type printer as claimed in claim 12, wherein the auxiliary developer liquid supplying device further includes a pump connected to said tube.

14. The developing device of a wet type printer as claimed in claim 2, further comprising a smoothing portion located on one side of said auxiliary reservoir, and adjacent said developing roller.

15. The developing device of a wet type printer as claimed in claim 1, further comprising a squeegee roller which removes excess developer liquid from the photosensitive belt, wherein said squeegee roller is located directly above said reservoir so that developer liquid removed from the photosensitive belt by the squeegee roller directly enters said reservoir.

16. A developing device, of a wet type printer, comprising:

a reservoir for holding developer liquid;

a developing roller installed at an upper region of the reservoir, said developing roller for contacting a photosensitive belt installed in the printer, wherein a blade is installed in contact with the developing roller in order to mechanically clean the surface of the developing roller; and a cleaning device for cleaning the developing roller, said cleaning device is provided with a rotatable shaft and a brush installed around the circumferential surface of the rotatable shaft, said cleaning device being in contact with the developing roller, wherein the cleaning device is installed within the reservoir so as to be immersed in the developer liquid.

17. The developing device of a wet type printer as claimed in claim 16, further comprising:

an auxiliary reservoir installed below the developing roller and within the reservoir to hold a predetermined amount of the developer liquid in which the lower portion of the developing roller is immersed to a predetermined depth, wherein said cleaning device is installed within said auxiliary reservoir.

18. The developing device of a wet type printer as claimed in claim 17, wherein said blade is within said auxiliary reservoir.

19. A developing device of a wet type printer comprising:

a reservoir for holding developer liquid;

a developing roller installed at an upper region of the reservoir, said developing roller for contacting a photosensitive belt installed in the printer;

a cleaning device for cleaning the developing roller, said cleaning device is provided with a rotatable shaft and a brush installed around the circumferential surface of the rotatable shaft, said cleaning device being in contact with the developing roller, wherein the cleaning device is installed within the reservoir so as to be immersed in the developer liquid; and, a motor which drives both said developing roller and said cleaning device.

20. The developing device of a wet type printer as claimed in claim 19, further comprising:

an auxiliary reservoir installed below the developing roller and within the reservoir to hold a predetermined amount of the developer liquid in which the lower portion of the developing roller is immersed to a predetermined depth, wherein said cleaning device is installed within said auxiliary reservoir.

* * * * *